US007934536B2

(12) United States Patent
Skerdi

(10) Patent No.: US 7,934,536 B2
(45) Date of Patent: May 3, 2011

(54) FEEDER COMPRISING A MOBILE SOCKET

(75) Inventor: Udo Skerdi, Bendorf/Rhein (DE)

(73) Assignee: AS Lungen GmbH, Bendorf/Rhein (DE)

( * ) Notice: Subject to any disclaimer, the term of this patent is extended or adjusted under 35 U.S.C. 154(b) by 535 days.

(21) Appl. No.: 11/816,679

(22) PCT Filed: Feb. 20, 2006

(86) PCT No.: PCT/EP2006/001504

§ 371 (c)(1),
(2), (4) Date: Mar. 14, 2008

(87) PCT Pub. No.: WO2006/089699

PCT Pub. Date: Aug. 31, 2006

(65) Prior Publication Data

US 2008/0223543 A1 Sep. 18, 2008

(30) Foreign Application Priority Data

Feb. 23, 2005 (DE) ..... 10 2005 008 324

(51) Int. Cl.
*B22C 9/02* (2006.01)

(52) U.S. Cl. ..... 164/359; 164/360

(58) Field of Classification Search ..... 164/359, 164/360

See application file for complete search history.

(56) References Cited

U.S. PATENT DOCUMENTS

| | | | | |
|---|---|---|---|---|
| 7,320,355 | B2 | 1/2008 | Skerdi et al. | |
| 2004/0050526 | A1 * | 3/2004 | Skerdi et al. | 164/359 |

FOREIGN PATENT DOCUMENTS

| | | | |
|---|---|---|---|
| DE | 3621334 | C1 | 2/1988 |
| DE | 4119192 | A1 | 12/1992 |
| DE | 19642838 | A1 | 7/1997 |
| DE | 10142357 | A1 | 3/2003 |
| JP | 8103850 | A | 4/1996 |

OTHER PUBLICATIONS

English translation of International Preliminary Report on Patentability pertaining to international application No. PCT/EP2006/001504, filed in the U.S. under U.S. Appl. No. 11/816,679. This application may contain information material to the patentability of the current application.

* cited by examiner

*Primary Examiner* — Kuang Y Lin
*Assistant Examiner* — Steven Ha
(74) *Attorney, Agent, or Firm* — Scott R. Cox

(57) ABSTRACT

The invention relates to a feeder for cast metal, comprising a feeder head (1) having a cavity (5) that is open towards the surroundings via at least one opening (8), and a tubular body (2) which is guided through the opening (8) and arranged in a mobile manner. According to the invention, the tubular body (2) comprises an abutment (9) in the section thereof facing the cavity (5), said abutment (9) being capable of taking its bearing on a surface adjacent to the opening (8) in the cavity (5).

11 Claims, 4 Drawing Sheets

FEEDER COMPRISING A MOBILE SOCKET

The invention relates to a feeder for cast metal.

In the production of molded parts in the foundry, liquid metal is filled into a casting mold. The volume of the filled material reduces during the solidification process. Therefore, "feeders", i.e. open or closed spaces, are regularly used in or on the casting mold to compensate for the volume deficit during solidification of the cast part and prevent shrinkage cavitation in the cast part. To this end, the feeders are connected to the cast part or the endangered cast piece area and are normally arranged above or on the side of the die cavity.

Numerous feeders are known in the prior art. For example, DE 196 42 838 A1 describes a feeder for a metallic cast part in the form of a bell comprising a retracted bell wall which is formed by a fitted flat annular part.

DE 41 19 192 A1 describes a resilient arbor for holding for feeding. Therein, the feeder inserts are placed on an arbor connected to the casting mold and preferably molded in the top box. Due to the fact that the material of the feeders is very flexible and the sand pressure during molding in the molding device can easily lead to damage of the feeder used, it is known to form the arbor to be axially movable in a resilient manner so that the molded feeder can escape the sand pressure in the direction of the casting pattern.

The feeders are normally arranged approximately at gate height and are furthermore fitted with a heat-insulating material or exothermal masses such that the molten metal located in the feeder subsequently solidifies as the cast part itself. After solidification, the feeder remains connected to the cast part so that the residual feeder must subsequently be detached. Therein, clean and easy detachment of the feeder from the cast part is problematic in many cases. The cast surface must also regularly be deburred and smoothed after detachment of the feeder. This is a complex and correspondingly expensive operation which can also lead to damage to the surface of the cast part at the connection point to the feeder. In order to reduce such damage and facilitate detachment of the feeder, "crushing cores" (also referred to as the crushing edge, sand bar or Washburn cores) are often provided. These are fitted between the feeder and the casting mold and require corresponding attachment surfaces.

DE 101 42 357 A1 proposes a feeder system for a cast part comprising a feeder or feeder head and a tube-like body, the tube-like body connecting the feeder or feeder head directly or indirectly to the cast part or the hollow die body and contributing to the formation of a crushing edge. Therein, the tube-like body is preferably formed to be cylindrical. The tube-like body tapers towards the end thereof facing the cast part so that a crushing edge is formed.

When dispatching the feeder according to DE 101 42 357 A1, the feeder head and tube-like body are packaged as separate parts. In the case of production of the casting mold, the feeder system is then assembled in that the tube-like body is initially placed on the casting pattern and the feeder head is subsequently placed on the tube-like body.

The separate packaging of the feeder head and the tube-like body and the assembly of the feeder system in the case of production of the casting mold require additional operational steps. It is a general aim to keep the number of operational steps and the level of complexity as low as possible.

The object of the invention was therefore to provide a feeder for cast metal which can be easily packaged and transported and which can be easily attached to the casting pattern in the case of production of a casting mold.

This object is achieved with a feeder for cast metal with the features of patent Claim 1. Advantageous embodiments of the feeder according to the invention are the subject matter of the dependent patent Claims.

The feeder according to the invention for cast metal comprises a feeder head which has a cavity in the interior thereof. This cavity is used during casting to receive liquid metal and release the metal again during solidification of the metal in the die cavity of the casting mold in order to compensate for the loss in volume which occurs during solidification of the cast part. The cavity is open towards the surroundings via an opening. A tubular body which, for this purpose, is guided through the opening is received in this opening. Therein, the tubular body is arranged such that it is mobile in the opening in the direction of the longitudinal axis thereof. In the section thereof facing the cavity, the tubular body has an abutment which can take its bearing on a surface adjacent to the opening in the cavity. For the purpose of packaging, the tubular body can therefore be pushed into the feeder head and is therefore protected, for example, from damage. Moreover, the feeder according to the invention forms only a single unit, i.e. the entire feeder can be packaged in a single packaging and it is not necessary that, in the case of production of the casting mold, the feeder is first assembled from the tubular body and the feeder head. A falling out of the tubular body from the feeder head or a tilting is prevented by the abutment provided on the tubular body. If the feeder according to the invention is therefore removed from its packaging, there is no risk that the feeder can fall apart into its components, i.e. the feeder head and the tubular body. Rather, the feeder forms one unit which is very easy to handle. To produce the casting mold, the feeder is then placed on a corresponding spring arbor and the tubular body is pulled out until it sits with the lower end thereof on the feeder base or the casting pattern.

The requirement of simple packaging and simple transport is solved on the one hand by the feeder according to the invention since the feeder can be packaged and dispatched as an individual unit. There is thus no longer any need as before to package two separate parts, i.e. the tubular body and the feeder head, separately. On the other hand, the requirement of simple handling is solved in the case of production of the casting mold due to the fact that the feeder is already assembled and only the tubular body has to be pulled out in order to produce the connection between the feeder head and the casting pattern or the die cavity.

The tube-like body can have any desired length, wall thickness and diameter which are suitable in the individual case. The wall thickness will generally lie, as a function of the material used, between 0.1 mm and 10 mm, particularly between 0.3 mm and 5 mm, preferably between 0.3 mm and 0.5 mm. The optimum dimensions can be determined in individual cases using routine tests or are known to the person skilled in the art because of his experience. The wall thicknesses also vary due to the material and can be approximately 0.3 mm to 0.5 mm e.g. for steel sheet metal using a spring arbor mini feeder.

In general, the tube-like body has a length between approximately 15 and approximately 300 mm, in particular approximately 35 and approximately 100 mm. The length of the tube-like body is selected in the case of an embodiment according to the invention such that at least the distance between the feeder head (before casting in the case of arrangement of the feeder on an arbor) and the cast part is bridged.

The inner diameter of the tube-like body can in principle be selected as desired, wherein the opening at the bottom and/or top end of the tube-like body should be sufficiently large to ensure the flow of the molten metal in and/or out of the feeder during the casting and solidification process. The diameter of the tube-like body is generally based on the diameter of the opening provided in the feeder head, through which opening the tube-like body is guided and in which the tube-like body is mobile. The diameter of the tube-like body is generally selected such that a sufficient guidance of the tube-like body is ensured through the opening in the feeder head when the tube-like body is pushed into the feeder head and/or pulled out of the feeder head before attachment to the casting mold and/or falls out in the case of correspondingly adjusted play between the tube-like body and the feeder as a result of gravity.

The tube-like body can be formed from any suitable material which has a corresponding strength and has no disruptive reaction to the cast part to be fed. These materials are familiar to the relevant person skilled in the art and comprise, for example, metal, plastic, board, ceramic or similar materials. The tubular body can also be constructed from an exothermal material. To this end, standard materials can be used as are already used to produce exothermal feeders. For example, silica sand or a comparable material can be mixed with an exothermal material such as magnesium chips or magnesium powder as well as an oxidizing agent such as sodium nitrate or sodium chlorate. A binding agent is furthermore added in order to give the mixture the required stability after removal from the mold. In this case, in principle any suitable binding agent can be used. Examples of suitable binding agents include water-glass, cold-hardening binding agents such as cold-box binding agents or no-bake binding agents or also hot-hardening binding agents. When such exothermal materials are used, the wall thickness of the tubular body can be selected to be slightly larger, preferably in the range between 2 and 5 mm. The tube-like body is preferably composed of a material which is similar to the casting range such as aluminum or iron sheet metal.

According to the invention, the tubular body has an abutment in the section thereof facing the cavity. The abutment is therefore arranged at such a position on the tubular body that it is located within the cavity provided in the feeder head. When pulling the tubular body out of the feeder head, the abutment takes its bearing on a surface which is adjacent to the opening in the cavity of the feeder head. In principle, the abutment of the tubular body can be formed as desired as long as it is ensured that the tubular body cannot fall out of the opening. The abutment can, for example, be formed as a thickening on the outside of the tubular body and run around the tubular body along the periphery thereof. However, individual projections can also be provided, wherein these can in principle have any desired form. For example, the projections can be formed as semispherical elevations or also as webs which run along sections of the periphery of the tube-like body. According to one preferred embodiment, the webs run parallel to the longitudinal axis of the tube-like body and are formed to be wedge-shaped. Therein, the maximum height of the wedge-shaped projections is selected such that their outer maximum distance is larger than the diameter of the opening in which the tubular body is inserted into the opening of the feeder head. The number of projections is preferably selected to be sufficiently high to prevent a tilting of the tubular feeder when it has been completely pulled out. The number of projections is therefore preferably at least 3. If 3 projections are provided, these are preferably arranged at an angle of 120° to one another. The abutment can be composed of the material of the tubular body and, for example, can be removed from the mold during production of the tubular body. However, it is also possible to design the abutment as a separate component and subsequently fasten this to the tubular body. The abutment of the tubular body can also be configured in such a manner that the outer diameter of the tubular body is enlarged in the direction of the end which is received by the cavity of the feeder head. The abutment is preferably formed as an annular projection which runs around the outer periphery of the tubular body. This ensures that the tubular body is centered during pulling out from the feeder head so that the longitudinal axis of the tubular body runs parallel to the longitudinal axis of the feeder head.

The abutment can be arranged at a distance from the end of the tubular body facing the cavity. This is, for example, advantageous if the feeder head has a large height so that the tubular body cannot be pulled out over the entire length thereof during attachment to the casting mold in order to produce the connection between the feeder head and the casting mold. However, the abutment is preferably arranged at the end of the tubular body facing the cavity of the feeder head. The abutment can then, for example, be formed as a border of the upper edge if the tubular body is produced, for example, from metal. In this embodiment, the abutment is therefore formed in the form of a collar which runs around the periphery of the tubular body at the end of the tubular body.

In one preferred embodiment of the feeder according to the invention, the tubular body has an outer diameter which is so much smaller than the diameter of the opening that the tubular body can perform a displacement movement under the influence of the dead weight thereof. If the feeder is rotated, the tubular body can automatically move into the feeder head under the effect of the dead weight thereof. On the contrary, the tubular body falls out of the feeder head in the event of renewed rotation under the dead weight thereof until it takes its bearing with the abutment thereof on the surface surrounding the opening in the feeder head. The feeder can therefore be very easily placed in a package with one hand or removed therefrom and placed on a spring arbor.

In one particularly preferred embodiment of the feeder according to the invention, the tubular body comprises such an extension in the direction of the longitudinal axis thereof that the tubular body does not protrude beyond the outer end of the opening in its pushed in position in which the tubular body is pushed into the cavity of the feeder head. In this manner, the tubular body disappears in its transport position completely within the cavity of the feeder head and is therefore protected from damage during transport.

The tube-like body can have, in principle, any desired cross-sectional form, for example, an oval or rectangular or polygonal geometry. However, the tubular body preferably has a circular cross-section. The opening in the feeder head is formed according to the shape of the tube-like body. If this has a circular cross-section, the opening in the feeder head is correspondingly designed to be circular.

According to one embodiment of the present invention, the tube-like body is a tube with a substantially uniform cross-section across the entire length. The ratio of wall thickness to the overall diameter of the tube is preferably between approximately 1:2 and 1:200, in particular 1:5 and 1:120 and particularly preferably 1:10 and 1:100. The ratio of length to total diameter of the tube is preferably between 1:4 and 15:1, in particular 1:1 and 6:1. In particular, the ratios are based on the geometry of the feeder head and the casting mold.

According to one preferred embodiment according to the invention, the tube-like body tapers towards the end thereof facing away from the feeder head. If the feeder according to the invention is placed on an arbor on a casting pattern, the tubular body tapers towards the cast part and forms a crushing edge directly at the transition to the casting mold or in immediate proximity thereto. Of course, according to one embodiment of the invention, only a specific section, preferably the section facing the cast part, can also comprise a tapering or a narrowing of the inner diameter. The tube-like body is thus used on the one hand to provide a feeder throat which can be removed from the mold and on the other hand to provide a precise crushing edge with a fixed position. The crushing edge is preferably provided as a constriction of the opening or of the inner diameter at or close to the end of the tube-like body facing the cast part.

According to a further embodiment according to the invention, the tube-like body, however, does not taper towards the end facing away from the feeder head or has no tapering section. In this embodiment of the tube-like body, the wall preferably runs parallel to the longitudinal axis of the tube-like body. If the feeder according to the invention is placed on an arbor, in particular a spring or guide arbor, on a casting pattern of the casting mold, the tube-like body can be pulled out of the feeder head until the end of the tube-like body facing the cast part sits on the base of the arbor close to the cast part. Therein, a small gap is formed between the tube-like body and the base of the arbor. It has been shown that this gap, together with air occlusions generated during molding in this area, can also lead to the formation of an acceptable crushing edge. Moreover, the position and characteristics of the crushing edge can be optimized through the dimensioning of the tube-like body, e.g. by using a comparatively narrow tube with a small diameter or a corresponding arrangement of the feeder or feeder head so that this lies very close to (but not directly on) the cast part after the molding or compressing of the molding material.

When attaching the feeder according to the invention to the casting model, said feeder is placed on an arbor, in particular a spring arbor. The feeder head connected to the tube-like body is correspondingly held high by the arbor. Therein, the tubular body stands on the casting pattern or on the angled base of the arbor. If a spring arbor is used, the feeder head is guided by the spring arbor via the tube downwards into the corresponding end position during the molding process. The tubular body remains fixed in the original position so that it is ensured that a defined crushing edge is provided directly on the cast part. During compression of the molding material, the feeder head moves towards the casting pattern relative to the tubular body.

In the context of the present invention, any core, arbor or spring arbor which appears to be suitable to the person skilled in the art can be used. Towards the cast part or casting pattern, the tube-like body can either completely engage over the spring arbor or stand on the base thereof. In both cases, a connection between the die cavity of a casting mold and the tube-like body is produced.

The feeder head of the feeder according to the invention encompasses a cavity within which the tube-like body can be moved. The cavity opens at one end thereof and the tubular body is guided through the opening. In the pulled out state, the abutment provided on the tubular body takes its bearing on a surface which is adjacent to the opening in the cavity of the feeder head. In principle, this surface can be configured as desired provided that it is ensured that the tubular body cannot fall out of the cavity. To this end, a projection can be provided adjoining the opening in the cavity, said projection running in an annular manner around the inner surface of the cavity. The inner diameter of the annular projection is then selected to be smaller than the outer diameter of the abutment provided on the tubular body. The surface adjacent to the opening in the cavity of the feeder head can, however, also be formed such that the cavity of the feeder head tapers in the direction of the opening. In this case too, the tubular body is prevented from falling out of the cavity of the feeder head in that the diameter of the opening is smaller than the outer diameter of the abutments provided on the tubular body. Moreover, the surface on which the abutment of the tubular body can take its bearing can also be formed in such a manner that individual projections are provided on the surface of the cavity, said projections being arranged adjacent to the opening of the cavity. This can, for example, be advantageous when the abutment is formed on the tubular body as a peripheral ring.

According to a further embodiment of the feeder according to the invention, a surface of the cavity opposite the opening of the feeder head forms an abutting piece on which the tubular body takes its bearing in the pushed in position. The dimensions of the tube-like body and the cavity or the feeder head are therefore preferably matched to one another in such a manner that, in the pushed in position in which the feeder is normally transported, the tube-like body is entirely pushed into the cavity of the feeder head. On the other hand, the length extension of the tube-like body and the height of the cavity are matched to one another in such a manner that the tubular body cannot fall into the cavity during transport. Where required, a further abutment can also be provided on the tubular body which prevents the tube-like body from falling into the cavity of the feeder head.

The feeder head is preferably constructed from at least two parts which are connected to the feeder head by a connection means. When producing the feeder according to the invention, the tube-like body is first inserted into the opening which produces the connection between the cavity and the surroundings in the finished feeder. The second part of the feeder head is subsequently connected to the first part so that the cavity in the feeder head is generated and the tube-like body is fixed in the feeder head in such a manner that it cannot fall out.

For the provision of the first and the second part, the feeder head can be advantageously divided either parallel to the longitudinal axis of the tubular body in the finished feeder or perpendicular to the longitudinal axis of the tubular body. In the case of a division parallel to the longitudinal axis of the tube-like body, two parts which are substantially a mirror-image of one another are obtained, said parts respectively having a semi-circular notch. In the assembled feeder head, the two notches then produce the opening which connects the cavity of the feeder head to the surroundings. If the division of the feeder head is performed perpendicular to the longitudinal axis of the tube-like body, a lower part is obtained which encompasses the opening for insertion of the tubular body, and an upper part which is formed to be cover-shaped and forms the cavity together with the lower part of the feeder head.

The parts of the feeder head can be connected with any desired connection means. Suitable connection means include, for example, clamps, nails or metal bands. However, the parts are preferably glued to one another. Therein, in principle, any desired adhesive can be used as known from the foundry industry. Suitable examples include organic adhesives, glues or particularly preferably water-glass. It is also possible to configure both parts of the feeder head in such a manner that one part has a projection and the other part a corresponding recess in which the projection can be received. The connection between the parts can then also be produced in such a manner that a clamping connection is produced. To this end, corresponding sections of the feeder head parts can be matched to one another in a precisely fitting manner or sections are provided which are destroyed when the parts are fitted together to generate a clamping connection.

According to a further advantageous embodiment, a recess for receiving and centering an arbor is provided in the feeder head.

The feeder head can be formed from any insulating and/or exothermal material known in the prior art in order to ensure that the molten metal located in the feeder later solidifies as the cast part itself. The feeder head can, for example, be embodied as an exothermal feeder. In this case, the feeder head can, for example, be produced from an exothermal feeder mass which includes aluminum and/or magnesium, an oxidizing agent, for example, a nitrate, a temperature-resistant $SiO_2$-containing filler and a binding agent. As the binding agent, for example, an alkali silicate or an organic polymer can be used as normally used, for example, in the coldbox method.

If the feeder head is composed of several parts, the individual parts can also be produced from different materials. For example, the feeder head can comprise a lower part which is embodied as an insulating or exothermal body and an upper, preferably cover-shaped part which is produced, for example, from board, plastic, wood, sheet metal or composite materials.

The dimensioning of the feeder head is in principle as desired and is selected correspondingly in terms of the cast part to be produced. The wall thickness of the feeder head is based on its size and, for example, whether the feeder is supposed to be embodied to be exothermal or insulating. The wall thickness is normally between approximately 3 mm and 3 cm.

The invention further relates to a method for producing a feeder as has been described above.

To this end, a tubular body is initially provided which has an abutment; a first feeder part is further provided which has an opening or recess which is adapted to the periphery of the tubular body. If the tubular body has, for example, a circular cross-section, the opening also possesses a circular cross-section. If a recess is provided in the first feeder part, said recess thus possesses the shape of a semi-circle. The tubular body is then inserted into the opening or the recess such that the abutment of the tubular body can take its bearing on the surface of the first feeder part surrounding the opening and arranged in the finished feeder head in the cavity. Furthermore, a second feeder part is provided which can form a feeder head with a cavity together with the first feeder part. If a recess in which the tubular body is inserted is provided in the first feeder part, a corresponding recess is also provided in the second feeder part. The first feeder part and the second feeder part are subsequently connected to one another in such a manner that, in a pushed in position, the tubular body takes its bearing on a surface of the feeder head which is arranged opposite the opening and, in a pulled out position, takes its bearing with the abutment and the surface surrounding the opening.

The invention is explained in greater detail below with reference to the attached drawing. Therein:

Figure 1:
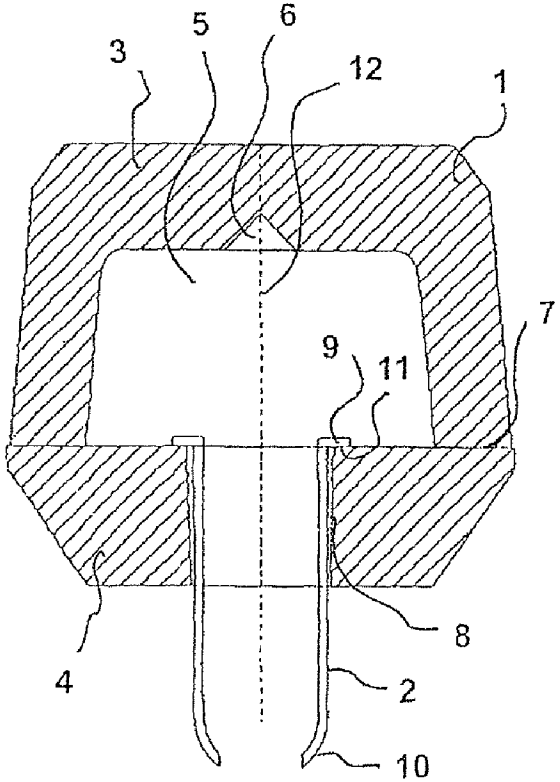
FIG. 1 shows a longitudinal section through a feeder according to the invention, the tubular body being located in a pulled out position.

FIG. 1 shows a longitudinal section through a feeder according to the invention parallel to longitudinal axis 12. Said feeder is constructed from a feeder head 1 and a tube-like body 2. The feeder head is constructed from two parts, an upper part 3 and a lower part 4. The first and second feeder parts together form a cavity 5. In upper feeder part 3, a recess 6 is further provided which can receive the tip of an arbor (not shown), with which tip the feeder can be positioned on a casting pattern (not shown). Upper feeder part 3 and lower feeder part 4 are connected to one another by means of a bonding 7. An opening 8 is provided in lower feeder part 4, opening 8 connecting cavity 5 to the surroundings. Tubular body 2 is inserted into opening 8. Tubular body 2 has a circular cross-section. An abutment 9 is provided at the end thereof facing cavity 5, abutment 9 running around the outer periphery of tubular body 2. The diameter of tubular body 2 is matched to the diameter of opening 8 so that tubular body 2 can be easily pushed into cavity 5 or pulled out therefrom. At the end thereof facing the cavity, tubular body 2 runs out in a tapering 10 which contributes to the formation of a crushing edge after production of the casting mold. FIG. 1 shows the feeder according to the invention in a state in which tubular body 2 is entirely pulled out of feeder head 1. In this case, abutment 9 takes its bearing on surface 11 such that tubular body 2 is prevented from falling out. Such a state occurs, for example, if the feeder is removed from a package and held in such a manner that it is held downward with the side from the tubular body protrudes.

Figure 2:
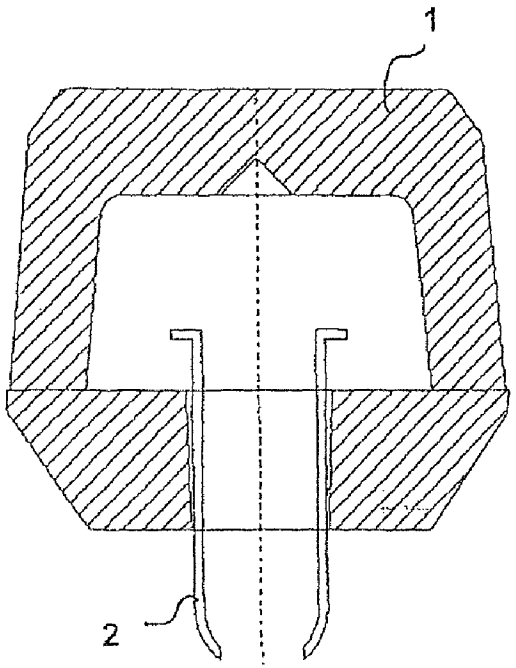
FIG. 2 shows a longitudinal section through a feeder according to the invention, the tubular body being partially pushed into the feeder cavity.

FIG. 2 shows a state in which tubular body 2 is partially pushed into feeder head 1. Tubular body 2 is inserted in feeder head 1 in such a manner that only a small resistance occurs during movement of tubular body 2. FIG. 2 therefore corresponds, for example, to a state as occupied during production of the casting mold after compression of the molding material. During compression of the molding material, feeder head 1 moves in the direction of tubular body 2. Due to the fact that tubular body 2 stands on the casting pattern with the tapered end thereof, feeder head 1 and tubular body 2 move relative to one another.

Figure 3:
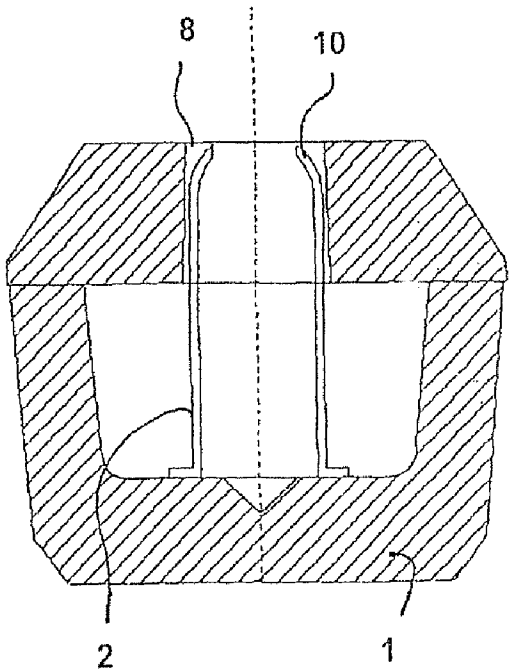
FIG. 3 shows a longitudinal section through a feeder according to the invention, the tubular body being pushed into the feeder cavity.

FIG. 3 shows a state as is occupied, for example, for the dispatch of the feeder according to the invention. Therein, the feeder is rotated relative to the position shown in FIG. 1 so that tubular body 2 slides into cavity 5 of feeder head 1 under the influence of gravity. Therein, tubular body 2 takes its bearing on the inner surface of feeder head 1 on the side of cavity 5 opposite opening 8. Therein, the length of tubular body 2 is selected such that it is entirely received by feeder head 1 so that tapered end 10 of tubular body 2 does not protrude beyond the end of opening 8. Tubular body 2 can therefore not be damaged during transport.

Figure 4:
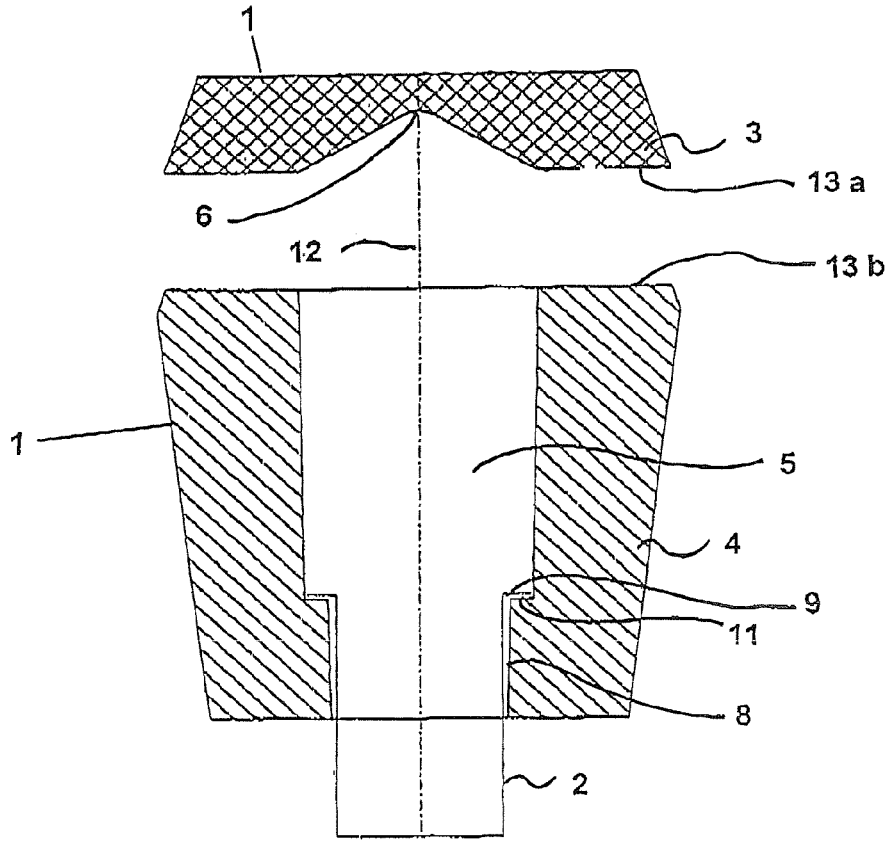
FIG. 4 shows a longitudinal section through a feeder according to the invention, the feeder head being constructed from a lower part and a cover.

FIG. 4 shows an embodiment of the feeder according to the invention in which upper part 3 of feeder head 1 has a flat, cover-shaped form. Upper part 3 can, for example, be composed of board, an insulating or exothermal mass as is usually used for the production of feeders or also of a ceramic material. A recess 6 is formed in the underside of upper part 3 facing lower part 4 of feeder head 1, recess 6 being capable of receiving the tip of a spring arbor (not shown) in order to center the feeder according to the invention on a casting pattern (not shown). Upper part 3 and lower part 4 jointly form a feeder head 1. To this end, upper part 3 and lower part 4 of the feeder head are, for example, connected by gluing. To this end, upper part 3 and lower part 4 have corresponding surfaces 13 a, b on which a corresponding adhesive, for example, water-glass, is applied. After gluing, a feeder head 1 is obtained which encompasses a cavity 5. As already explained in the case of the embodiments of FIGS. 1 to 3, lower part 4 of feeder head 1 encompasses an opening 8 in which a tubular body 2 is inserted. The tubular body is configured in such a manner that it can be moved in the direction of longitudinal axis 12 of the feeder according to the invention. Tubular body 2 has an abutment 9 which can take its bearing on a corresponding surface 11 of lower part 4.

Figure 5:
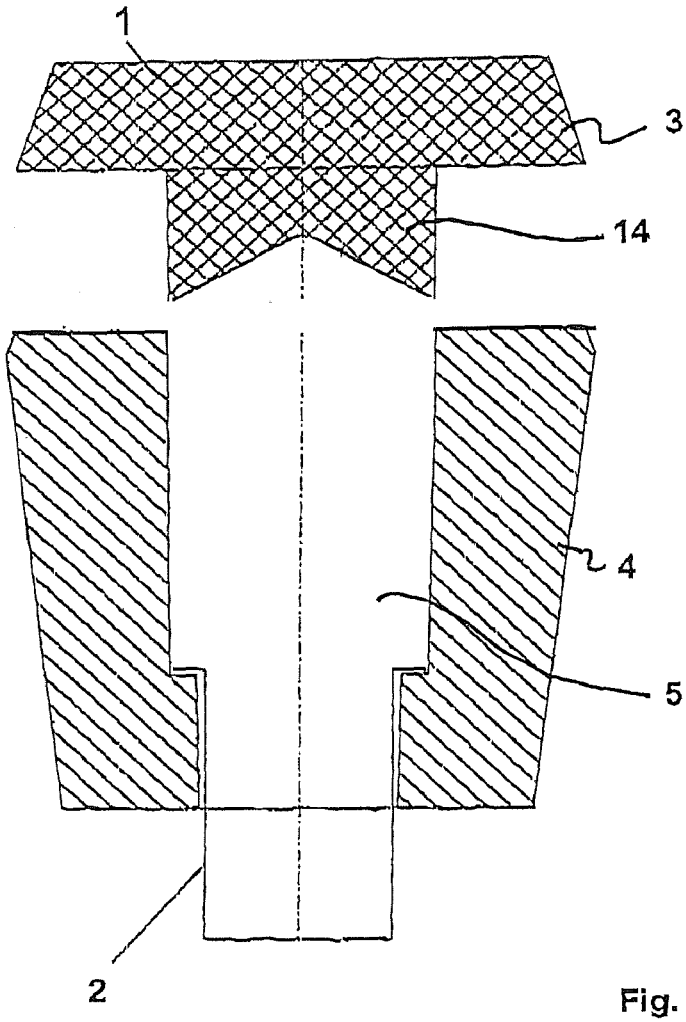
FIG. 5 shows a longitudinal section through a feeder according to the invention, the feeder head being constructed from a lower part and a cover.

FIG. 5 shows a further embodiment of the feeder according to the invention, wherein said feeder, similarly to the embodiment shown in FIG. 4, comprises a cover-shaped upper part 3 of feeder head 1. In this embodiment, upper part 3 comprises, however, an extension 14 on the side thereof facing lower part 4, which extension 14 can be inserted into the recess of lower part 4 forming cavity 5. The outer periphery of extension 14 is adapted to the shape of the wall of cavity 5 in terms of its shape and size. The diameter of extension 14 can be approximately equal to the diameter of the upper section of cavity 5 such that the connection between upper part 3 and lower part 4 is produced by a clamping connection which is generated by pressing of extension 14 into cavity 5. In order to improve the adhesion between parts 3, 4, projections, for example, wedge-shaped projections, which are destroyed during pressing of upper part 3 into lower part 4 in order to produce a sufficiently stable clamping connection between both parts 3, 4, can be provided on the peripheral surface of extension 14 or the corresponding sections of the peripheral surface of cavity 5. Lower part 4 and tubular body 2 correspond substantially to the corresponding parts of the feeder shown in FIG. 4.

Figure 6:
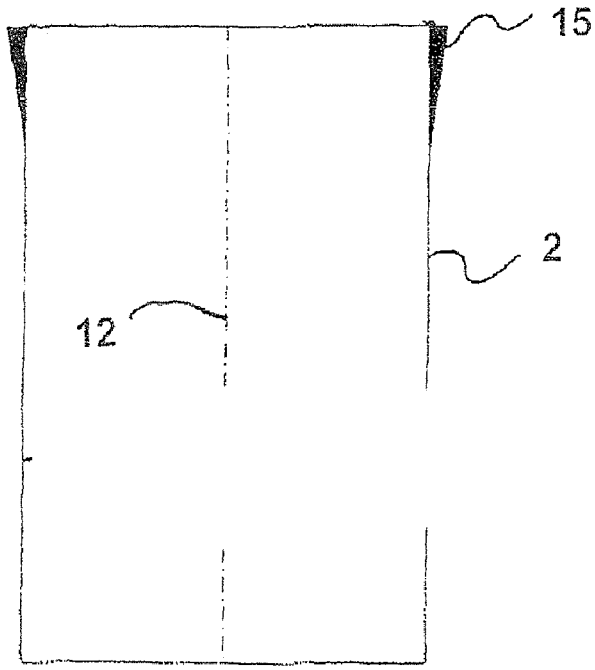
FIG. 6 shows a longitudinal section through a tube-like body.

FIG. 6 shows a longitudinal section through a tube-like body as is used in the feeder according to the invention. In this embodiment, the inner wall of the tubular body runs parallel to longitudinal axis 12 and does not taper towards the lower end of tubular body 2. Outwardly wedge-shaped projections 15 which act according to the invention as an abutment of the tubular body are provided at the upper end of tubular body 2. If tubular body 2 is inserted into a feeder head 1 in a manner analogous to that shown in FIGS. 1 to 5, wedge-shaped projections 15 come into contact with the upper section of opening 8 so that tubular body 2 cannot fall out of opening 8. The maximum strength of the wedge-shaped projections is therefore selected such that the maximum outer distance of wedge-shaped projections 15 is larger than the diameter of opening 8.

EXPLANATION OF SYMBOLS

1 Feeder head
2 Tube-like body
3 Upper part
4 Lower part
5 Cavity
6 Recess
7 Bonding
8 Opening
9 Abutment
10 Tapering
11 Surface
12 Longitudinal axis
13 *a,b* Surfaces
14 Extension
15 Wedge-shaped projections

The invention claimed is:

1. A casting mold feeder comprising a feeder head having a first feeder part and a second feeder part that when joined form a cavity that is open towards the surroundings via at least one opening in the first feeder part, and a tubular body which is guided through the at least one opening and arranged in a mobile manner therein, the tubular body comprising an abutment facing the cavity, wherein the abutment contacts a surface surrounding the at least one opening when pulled out from the feeder head, wherein the tubular body further comprises an extension in a direction of the longitudinal axis thereof such that the tubular body in a pushed in position does not protrude beyond an end of the at least one opening when the tubular body is pushed into the cavity of the feeder head and wherein the tubular body is movable from the pushed in position to the pulled out position and vice versa without the tubular body falling out of the at least one opening.

2. Feeder according to claim 1, wherein the abutment comprises an annular projection which runs around an outer periphery of the tubular body.

3. Feeder according to claim 1, wherein the abutment is arranged at the end of the tubular body facing the cavity.

4. Feeder according to claim 1, wherein the tubular body has an outer diameter which is smaller than a diameter of the opening such that the tubular body can perform a displacement movement under the influence of a dead weight thereof.

5. Feeder according to claim 1, wherein the tubular body has a circular cross-section.

6. Feeder according to claim 1, wherein the tubular body is tapered in a cross-section thereof at its end thereof facing away from the cavity.

7. Feeder according to claim 1, wherein a surface of the cavity opposite the opening forms an abutting piece on which the tubular body rests when in the pushed in position.

8. Feeder according to claim 1, wherein the two parts of the feeder head are connected by a connection means.

9. Feeder according to claim 8, wherein the connection means comprises an adhesive.

10. Feeder according to claim 1, wherein the feeder head further comprises a recess for receiving and centering an arbor in the feeder head.

11. A method of producing a casting mold feeder comprising:

preparing a tubular body having an abutment;

preparing a first feeder part having an opening which is adapted to a periphery of the tubular body and wherein the opening leads to exterior surroundings when joined with a second feeder part;

inserting the tubular body into the opening so that the abutment of the tubular body rests on a surface of the first feeder part surrounding the opening in a pulled out position;

preparing a second feeder part, which forms a feeder head with a cavity when combined with the first feeder part; and connecting the first feeder part and the second feeder part to one another in such a manner that, in a pushed in position, the tubular body abutment contacts a surface of the feeder part opposite the opening and, in a pulled out position, the abutment contacts the surface of the first feeder part forming the opening, and the tubular body is movable from the pushed in position to a pulled out position and vice versa.

* * * * *